United States Patent [19]

DeVito

[11] Patent Number: 4,916,493

[45] Date of Patent: Apr. 10, 1990

[54] EXIT ROLLER REVERSAL GATE FOR DUPLEX PRINTING

[75] Inventor: Gerald M. DeVito, Ontario, N.Y.

[73] Assignee: Xerox Corporation, Stamford, Conn.

[21] Appl. No.: 398,117

[22] Filed: Aug. 24, 1989

[51] Int. Cl.[4] ..... G03G 21/00; G03G 15/00; B65H 29/66

[52] U.S. Cl. ..... 355/321; 355/319; 271/3.1; 271/186

[58] Field of Search ..... 355/309, 317, 318, 319, 355/320, 321; 271/3.1, 184, 186, 291, 902

[56] References Cited

U.S. PATENT DOCUMENTS

| | | | |
|---|---|---|---|
| 3,108,801 | 10/1963 | Van Dalen | 271/57 |
| 3,173,684 | 3/1965 | Binzoni et al. | 271/57 |
| 4,110,030 | 8/1978 | Knechtel | 355/319 X |
| 4,275,958 | 6/1981 | Tachika et al. | 355/309 X |
| 4,348,101 | 9/1982 | Schonfeld et al. | 355/14 |
| 4,493,483 | 1/1985 | Teumer | 271/186 |
| 4,494,747 | 1/1985 | Graef et al. | 271/263 |
| 4,508,444 | 4/1985 | May et al. | 355/317 X |
| 4,692,020 | 9/1987 | Tsujihara | 355/14 |
| 4,699,503 | 10/1987 | Hyltoft | 355/14 |
| 4,708,462 | 11/1987 | Stemmle | 355/24 |
| 4,727,401 | 2/1988 | Partilla et al. | 355/319 |
| 4,787,616 | 11/1988 | Sasaki et al. | 271/3.1 |

OTHER PUBLICATIONS

IBM Technical Disclosure Bulletin, vol. 20, No. 1, Jun. 1977.

Xerox Pending Patent Appln. No. D/88161, Ser. No. 07/288,491, filed 12/22/88.

*Primary Examiner*—A. T. Grimley

*Assistant Examiner*—William J. Royer

[57] ABSTRACT

In a reproduction apparatus outputting copy sheets via exit rollers and stacking the outputted copy sheets adjacent the exit rollers in a stacking tray, and which exit rollers are reversible in their direction of rotation to feed selected copy sheets imaged on one side back into the reproduction apparatus in a return path to be reimaged, an actuatable gate system prevents the previously outputted and stacking copy sheets from being recaptured by the reversed rotation exit rollers, by interposing a guide or baffle between the stacking copy sheets and the exit rollers to prevent accidental reacquisition of copy sheets by the reversed rollers automatically in response to the reversal in direction of rotation of the exit rollers. The guide or baffle preferably comprises commonly rotatably mounted arcuate fingers closely adjacent the exit rollers, which fingers are automatically rotated to extend outside of the periphery of the exit rollers towards the stacking tray in response to the reversal in direction of rotation of the exit rollers. That may be accomplished by camming this finger rotation from an axial shifting of the exit rollers also providing lateral deregistration.

5 Claims, 4 Drawing Sheets

EXIT ROLLER REVERSAL GATE FOR DUPLEX PRINTING

This invention is particularly applicable to known, desirable, systems in copiers or printers for printing copy sheets from optical or electronic page information utilizing reversible, dual mode, copy sheet rollers. In particular, there is disclosed a system for automatically interposing guide or baffle means to prevent accidental re-acquisition of copy sheets previously fed from copy sheet rollers when the copy sheet feed rollers are reversed. This disclosed system for automatically interposing guide or baffle means to prevent accidental reacquisition of copy sheets by the reversed rollers has particular utility with copy sheet exit rollers which eject copy sheets for adjacent copy sheet tray or sorter bin stacking but are reversible to return selected copy sheets into a duplex path with inversion for second side copying, or for second pass same side overprinting, such as for highlight color. The disclosed system automatically prevents previously ejected stacking copy sheets from being recaptured by the reversed rotation rollers, yet does not interfere with normal sheet feeding. Inadvertently pulling exited sheets back into the machine can cause paper jams, etc. The specific disclosed embodiment can also effectively and efficiently utilize an existing axial (side-shifting) movement of the copy sheet exit rollers, serving another purpose, for the automatic interposing of the guide or baffle means.

There is disclosed herein an improvement in simple low cost duplexing or other second pass copying systems providing a simple integrated copy sheet output and optional copy sheet return path, such as that shown and described in U.S. Pat. No. 4,708,462 noted below, or otherwise. The system disclosed herein is usable with various other types of duplexing or other second pass copying systems. These may be with trayless buffer loops, or with copy sheet stacking and refeeding from a buffer tray between the first and second copying (image transfer) operations, or a combination thereof. These systems are known in the published art.

Of particular published art interest, as the herein-disclosed example of a duplexing path copier with a dual mode inverter/output path feeder system with reversing exit rolls, for a choice or simplex or duplex copying, with which the present invention may be effectively utilized as shown herein, is Xerox Corporation U.S. Pat. No. 4,708,462 issued Nov. 24, 1987 to D. J. Stemmle, and art cited therein, (and also U.S. Pat. No. 4,660,963 issued Apr. 28, 1987 to D. J. Stemmle, and art cited therein). Other patent examples of duplexing copiers with duplexing paths including reversibe sheet output rollers functioning as sheet inverters include Canon Sasaki et al. U.S. Pat. No. 4,787,616, and Ricoh Tsujihara U.S. Pat. No. 4,692,020. [Said 4,708,462 to D. J. Dtemmle also discloses an optional path choice of a trayless duples loop path extending over and bypassing a duplex buffer tray.]U.S. Pat. No. 4,348,101 issued Sept. 7, 1982 to A. Schonfeld, et al. (Sperry Corporation), shows a duplex laser printer with somewhat similar output and inverting paths. Reversing duplex printing operation is also shown in U.S. Pat. No. 4,699,503 to Hyloft.

Other references of background interest include Graef U.S. Pat. No. 4,494,747 re selectively camming a fence 35 against a stack of sheets during a portion of the machine cycle in a currency dispenser to insure that the sheets are not picked up by the fed roll (see especially sheet 5 and Col. 7). To similar effect are Van Dalen U.S. Pat. Nos. 3,108,801 and Binzoni et al. 3,173,684. Xerox Corp. U.S. Pat. No. 4,493,483 to Teumer et al., and IBM TDB Vol. 20, No. 1, June 1977, page 22, by Bullock, show examples of a sheet reverser with a buckle control or kicker plate to insure feeding of a sheet being reversed into the correct nip.

Example of sheet lateral or side shifting or offsetting mechanisms are disclosed in U.S. Pat. Nos. 4,712,786 and 4,480,825. A helex and pin system therefore which is actuated by roller reversal for de-registration for duplex, like that disclosed herein, is disclosed in copending U.S. Ser. No. 07/288,491 filed Dec. 22, 1988 by George B. Brown and Denis M. Ankrom, with the same assignee (D/88161).

A specific feature of the specific embodiment disclosed herein is to provide in a reproduction apparatus with means for outputting copy sheets via exit rollers and stacking the outputted copy sheets adjacent said exit rollers in a stacking tray, and which exit rollers are reversible in their direction of rotation to feed selected copy sheets imaged on one side back into said reproduction apparatus in a return path to be reimaged, the improvement comprising; actuatable gate means for preventing previously outputted and stacking copy sheets from being recaptured by said reversed rotation exit rollers by interposing guide or baffle means between the stacking copy sheets in said stacking tray and said exit rollers to prevent accidental re-acquisition of copy sheets by the reversed rollers, said actuable gate means including means for automatically interposing said guide or baffle means between the stacking copy sheets and said exit rollers in response to said reversal in direction of rotation of said exit rollers.

Further specific features provided by the system disclosed herein, individually or in combination, include those wherein said guide or baffle means comprises arcuate fingers closely adjacent said exit rollers, which arcuate fingers are extended outside of the periphery of said exit rollers towards said stacking tray upon said actuation of said actuatable gate means in response to said reversal in direction of rotation of said exit rollers, wherein said guide or baffle means comprises commonly rotatably mounted arcuate fingers closely adjacent said exit rollers, which arcuate fingers are rotated to extend outside of the periphery of said exit rollers towards said stacking tray upon said actuation of said actuatable gate means in response to said reversal in direction of rotation of said exit rollers, and/or wherein said means for automatically interposing said guide or baffle means between the stacking copy sheets and said exit rollers in response to said reversal in direction of rotation of said exit rollers comprises camming means actuated by axial shifting of said exit rollers in response to said reversal in direction of rotation of said exit rollers.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus the present invention will be better understood from this description of an embodiment thereof, including the drawing figures (approximately to scale) wherein:

Figure 1:
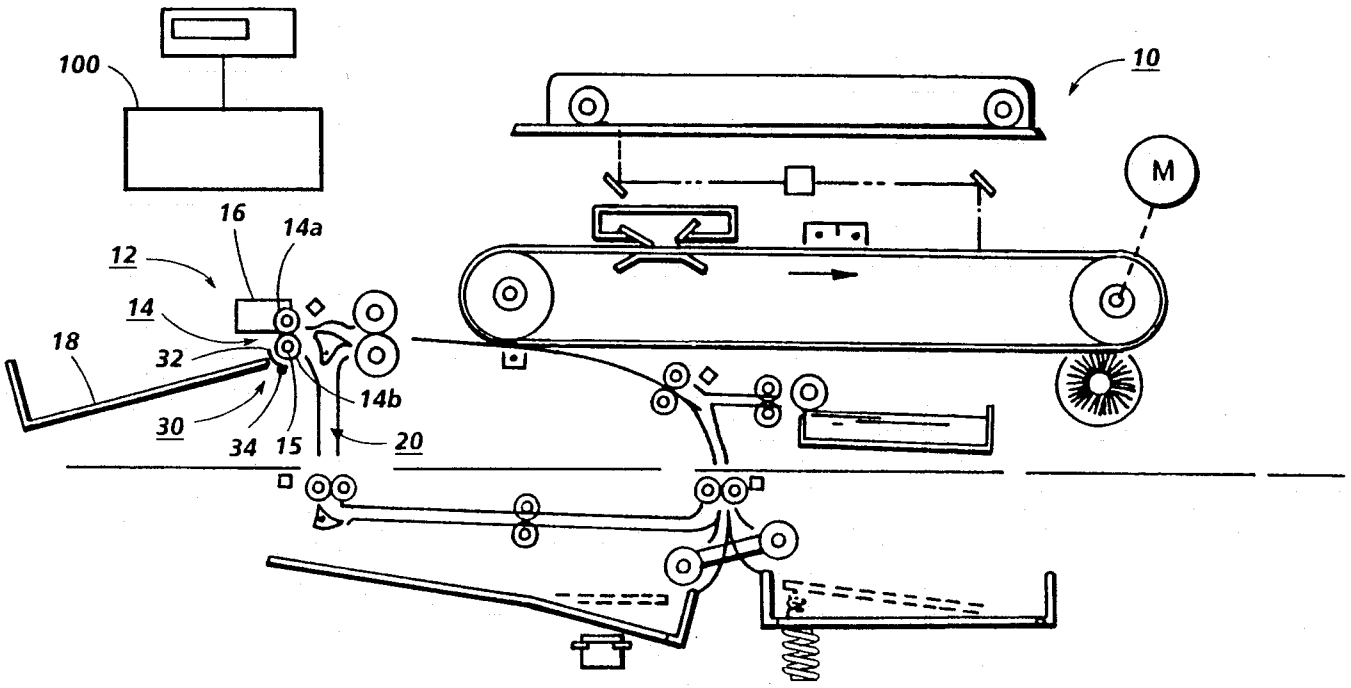
FIG. 1 is a schematic side view of one example of a duplex copier incorporating the exit roller reversal gate system of the invention.
Figure 2:
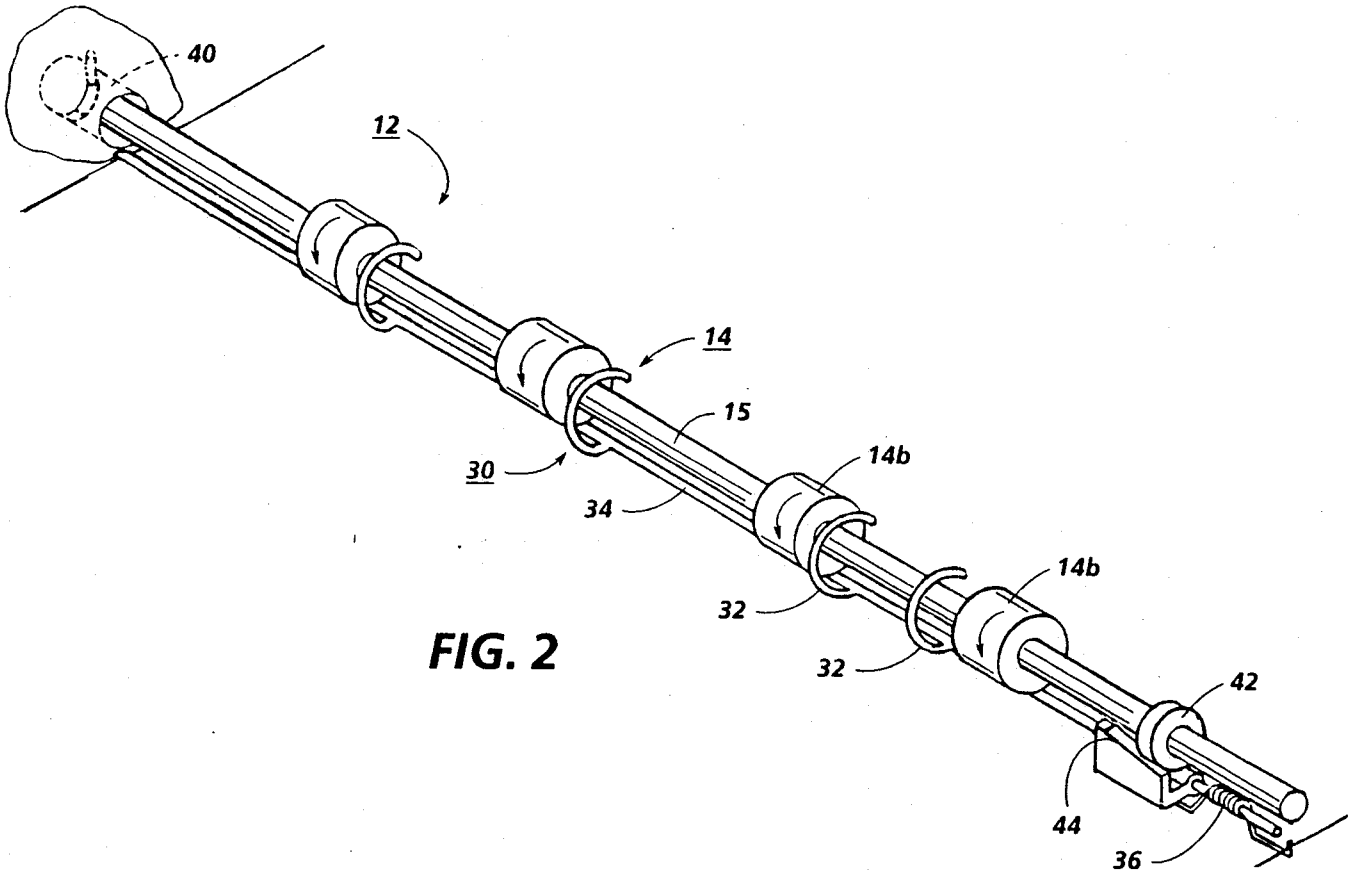
FIGS. 2 and 3 are otherwise identical perspective views of the exit roller reversal gate portion of the embodiment of FIG. 1, respectively showing the two operating positions of the exemplary exit roller gate mechanism, with respective movement arrows, but with the upper roller set not shown for drawing clarity.
Figure 3:
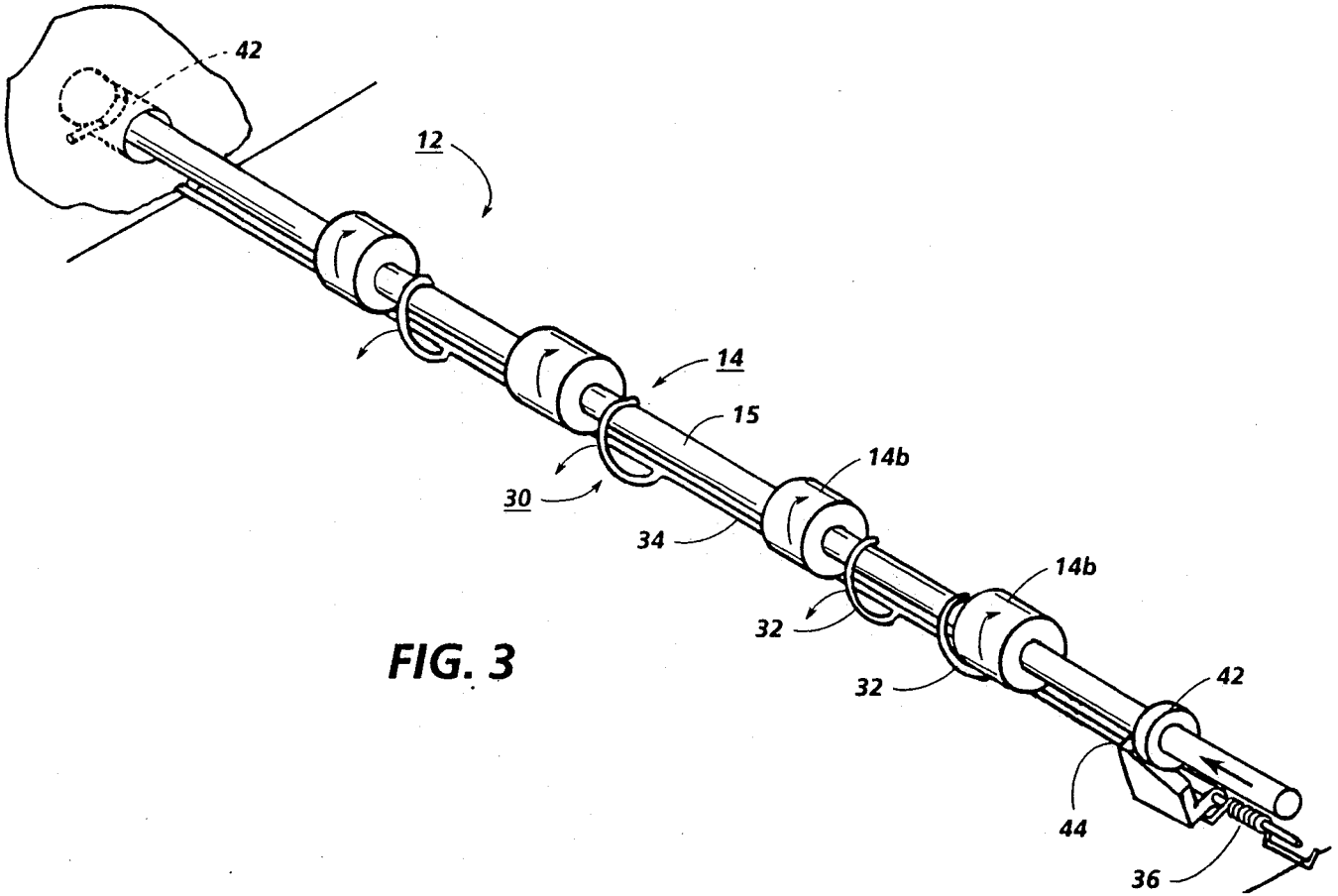
Figure 4:
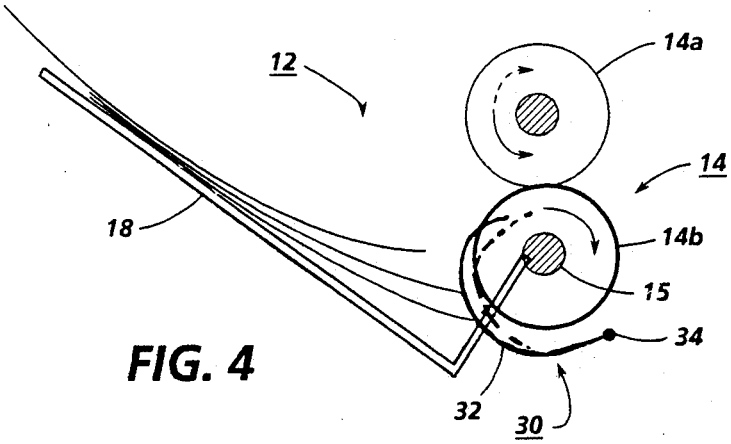

and FIG. 4 is an enlarged cross-sectional view of the copy sheet exit area of the embodiment of FIGS. 1–3, including the exit roller reversal gate portion, with the two operating positions of the exit roller gate respectively shown in solid and phantom lines.

With reference to the above-noted Figures, there is shown in FIG. 1 a duplex copier 10 by way of one example of an duplex electrostatographic reproducing machine of a type suitable to utilize the system of the present invention. While the machine 10 is exemplified here as an electrostatographic copier, other types of reproducing machines or apparatus such as laster or ink jet printers, etc., may be envisioned. Although the present system is particularly well adapted for use in such compact copiers or printers, it will be evident from the following description that it is equally well suited for use in a wide variety of reproduction systems and is not limited in application to the particular embodiment shown herein.

The FIG. 1 illustrated duplex copier 10 per se is that shown and described in the above-cited U.S. Pat. No. 4,708,462, and elsewhere, and thus need not be redescribed herein. Thus, the following description relates only to the subject copy sheet output path portion 12 of the copier 10, shown in more detail in FIG. 4 and FIGS. 2 & 3.

The subject copy sheet output path portion 12 particularly includes two mating or nipped sets of copy sheet output path rollers 14. The rollers 14 comprise a lower set of rollers **14*b* on an axially movable as well as rotatable shaft 15, and upper rollers 14*a*. One said set of the rollers 14 are selectably reversibly driven by a reversible drive 16**. The other roller set may, conventionally, be idlers.

The rollers 14 normal continue rotating in one direction to feed and drive the sheets downstream to eject the sheets out of this exit nip to be stacked into output tray 18 (a fixed single tray or or a selected sorter bin), as shown in more detail in FIG. 4. However, for duplexing copy sheets, the rollers 14 are reversed while a copy sheet only printed on its first side is still in the roller 14 nip, to transport those copy sheets back into a duplex path 20, for returning those copy sheets to the copy processor with inversion be imaged on their opposite sides to make duplex copies, as shown in FIG. 1. This is taught by the above-cited and other references, particularly the U.S. Pat. No. 4,708,462 embodiment disclosed here. To summarize, the sheet reversing for inverting function is integral the normal exit transport and paper path, implemented by reversal of rollers 14 and thus reversal of a sheet in the nip thereof. When output of a simplex or fully duplexed copy sheet is desired, the rollers 14 simply continue to rotate in the same forward or downstream feeding direction until the sheet is fully ejected from the rollers nip instead of reversing after only part of the sheet is extending therefrom.

Turning now to the disclosed system 30 for automatically interposing guide or baffle means to prevent accidental re-acquisition of copy sheets by the reversed rollers 14, this is embodied here by arcuate guide or baffle fingers 32 mounted to pivotal shaft 34 located closely adjacent, slightly under, and parallel to, shaft 15 of the lower set of rollers **14*b*. The fingers 32 are normally spring loaded by torsion spring 36 into the 'up' or first position shown in FIG. 2 (and also shown in phantom or dashed lines in FIG. 4) for normal downstream or forward sheet feeding for ejection and stacking. In this first operating position the arcuate guide or baffle fingers 32 are substantially inside of the radius of the lower set of rollers 14*b***, out of normal sheet engagement.

The disclosed embodiment utilizes an existing axial (side-shifting) movement of the copy sheet exit rollers 14, serving another purpose, for acutating the automatic interposing of the guide or baffle system 30 to prevent accidental re-acquisition of copy sheets previously fed from the rollers 14 when the rollers 14 are reversed. This second operating position of the guide or baffle fingers 32 is shown in FIG. 3 and also shown in solid lines in FIG. 4. As particularly shown in FIG. 4 in this second operating position of the fingers 32 they are substantially extended outside of the radius of the lower set of rollers **14*b*, downward and forward, to push away and hold away the rear edges of previously ejected sheets from the lower rollers 14*b*, and thus providing an active gate to prevent those sheets already in the exit tray 18 area from being engaged, picked up and fed back into the nip of rollers 14. That is a particular problem with copy sheets with fluff or curl, which tends to cause their rear edges to engage the rollers 14*b*, the surfaces of which are moving upwardly and into the nip when the rollers 14 are reversed. With the system 30, at least one gate finger 32 is closely operatively associated with each roller 14*b***, moving outside of the roller profile when the roller is reversed to shield it.

As shown particularly in FIG. 3, shaft 15 automatically shifts axially (see the movement arrow) when the reversible drive 16 reverses the direction of drive rotation. This may be accomplished by a helex couple 40, or various other conventional, cam or side-shifting mechanisms. As noted above, a similar helex and pin system actuated by roller reversal is disclosed in copending U.S. Ser. No. 07/288,491 filed Dec. 22, 1988 by George B. Brown and Denis M. Ankrom. There it is shown shifting the individual rollers, but the same mechanism may be used here at one end of the shaft 15 to shift the shaft 15. Other above-noted examples of sheet lateral (side) shifting or offsetting mechanisms are disclosed in U.S. Pat. Nos. 4,712,786 and 4,480,825. When the rotation of the shaft 15 is reversed the helex couple 40 translates or pulls the shaft 15. A camming roller 42 on shaft 15 engages an inclined plane cam follower 44 attached to pivotal shaft 32. Thus the axial shifting of shaft 15 and camming roller 42 thereon forces down cam follower 44 which causes a corresponding rotation of shaft 34 and the attached guide or baffle fingers 32 into the second operating position. This occurs automatically in response to the axial movement of the roller 14 system.

That axial movement of the reversible roller 14 system is provided for an additional reason and function other than the actuation of gate system 30. It also provides a de-registration system for duplexing, as per the above-noted U.S. Ser. No. 07/288,491. It side-shifts by a small distance (e.g., 3 to 3.5 mm) those copy sheets being reverse fed back into the duplex path 20 so that those sheets may be fed through the duplex path 20 without edge drag, and so that they can subsequently be re-side-registered for the second pass image by side sifting them back in one (known) direction of movement, irrespective of slight misregistrations or skewing in the duplex return path.

As is well known in the art, to control the operation of the machine 10, a suitable programmable controller 100 and a connecting control panel is preferably conventionally provided. Conventional and/or readily programmable software microprocessor controls may be used for controlling all machine and paper path operations and sensing.

While the embodiment disclosed herein is preferred, it will be appreciated from this teaching that various alternatives, modifications, variations or improvements therein may be made by those skilled in the art, which are intended to be encompassed by the following claims:

I claim:

1. In a reproduction apparatus with means for outputting copy sheets via exit rollers and stacking the outputted copy sheets adjacent said exit rollers in a stacking tray, and which exit rollers are reversible in their direction of rotation to feed selected copy sheets imaged on one side back into said reproduction apparatus in a return path to be reimaged, the improvement comprising;

actuatable gate means for preventing previously outputted and stacking copy sheets from being recaptured by said reversed rotation exit rollers by interposing guide or baffle means between the stacking copy sheets ins aid stacking tray and said exit rollers to prevent accidental re-acquisition of copy sheets by the reversed rollers, said actuable gate means including means for automatically interposing said guide or baffle means between the stacking copy sheets and said exit rollers in response to said reversal in direction of rotation of said exit rollers.

2. The reproduction apparatus of claim 1, wherein said guide or baffle means comprises arcuate fingers closely adjacent said exit rollers, which arcuate fingers are extended outside of the periphery of said exit rollers towards said stacking tray upon said actuation of said actuatable gate means in response to said reversal in direction of rotation of said exit rollers.

3. The reproduction apparatus of claim 1, wherein said guide or baffle means comprises commonly rotatably mounted arcuate fingers closely adjacent said exit rollers, which arcuate fingers are rotated to extend outside of the periphery of said exit rollers towards said stacking tray upon said actuation of said actuatable gate means in response to said reversal in direction of rotation of said exit rollers.

4. The reproduction apparatus of claim 1, wherein said means for automatically interposing said guide or baffle means between the stacking copy sheets and said exit rollers in response to said reversal in direction of rotation of said exit rollers comprises camming means acutated by axial shifting of said exit rollers in response to said reversal in direction of rotation of said exit rollers.

5. The reproduction apparatus of claim 4, wherein said guide or baffle means comprises arcuate fingers closely adjacent said exit rollers, which arcuate fingers are extended outside of the periphery of said exit rollers towards said stacking tray upon said actuation of said actuatable gate means in response to said reversal in direction of rotation said exit rollers.

* * * * *